US006484781B2

(12) United States Patent
Weaver

(10) Patent No.: US 6,484,781 B2
(45) Date of Patent: Nov. 26, 2002

(54) COLD PROCESS ROOFING FELT APPLICATOR

(76) Inventor: Joseph H. Weaver, 2319 Willow La., West Covina, CA (US) 91790

( * ) Notice: Subject to any disclaimer, the term of this patent is extended or adjusted under 35 U.S.C. 154(b) by 14 days.

(21) Appl. No.: 09/836,485

(22) Filed: Apr. 17, 2001

(65) Prior Publication Data

US 2002/0029859 A1 Mar. 14, 2002

Related U.S. Application Data

(63) Continuation-in-part of application No. 09/193,076, filed on Nov. 16, 1998, now abandoned.

(51) Int. Cl.[7] ..... E04D 15/06; E04D 5/00
(52) U.S. Cl. ..... 156/577; 156/71; 156/579
(58) Field of Search ..... 156/71, 574, 577, 156/578, 579

(56) References Cited

U.S. PATENT DOCUMENTS

| | | | | | |
|---|---|---|---|---|---|
| 1,837,861 | A | | 12/1931 | Green | |
| 1,953,990 | A | | 4/1934 | Roselund | 299/59 |
| 2,192,290 | A | * | 3/1940 | O'Neal | 156/390 |
| 3,097,986 | A | * | 7/1963 | Kauer | 156/497 |
| 4,101,356 | A | * | 7/1978 | Savelkouls | 156/272.2 |
| 4,290,842 | A | * | 9/1981 | Gable | 15/256.51 |
| 4,460,433 | A | * | 7/1984 | Boyd | 156/574 |
| 4,725,328 | A | * | 2/1988 | Arnold | 156/244.27 |
| 4,761,201 | A | * | 8/1988 | Nichols, Jr. | 156/497 |
| 4,781,782 | A | * | 11/1988 | Luhman et al. | 156/361 |
| 4,869,044 | A | * | 9/1989 | Wald | 156/379.8 |
| 5,213,278 | A | * | 5/1993 | Holbek et al. | 156/497 |
| 5,968,311 | A | * | 10/1999 | Zupon et al. | 156/574 |

* cited by examiner

*Primary Examiner*—Mark A. Osele
(74) *Attorney, Agent, or Firm*—Lawrence N. Ginsberg

(57) ABSTRACT

The applicator includes a frame assembly, a plurality of wheels attached to this frame assembly, a spindle assembly supported by the frame assembly, and a plurality of stress-relief rollers. The frame assembly includes left and right side support assemblies which include respective left and right side handle assemblies. Elongated support elements secure the left side support assembly to the right side support assembly. The wheels moveably support the frame assembly relative to the roof. The spindle assembly is supported by the left and right side support assemblies. The spindle assembly is capable of holding a spool of roofing felt. The stress-relief rollers extend between the left and right side support assemblies. When an operator desires to apply roofing felt, roofing felt is dispensed from the spool of roofing felt and is directed serially through the plurality of stress-relief rollers so as to relieve stress in the roofing felt prior to its application to the roof. An adhesive material dispenser assembly is attached to the frame assembly for dispensing adhesive material as the roofing felt is being applied. The applicator includes a final roller/segmented outfeed roller assembly operably attached to the frame assembly. When an operator desires to apply roofing felt, felt is dispensed from the spool of roofing felt and is directed under a segmented roller of the final roller/segmented outfeed roller assembly for providing enhanced urging of the roofing felt against the roof in a manner that compensates for roof surface irregularities.

20 Claims, 3 Drawing Sheets

FIG. 4
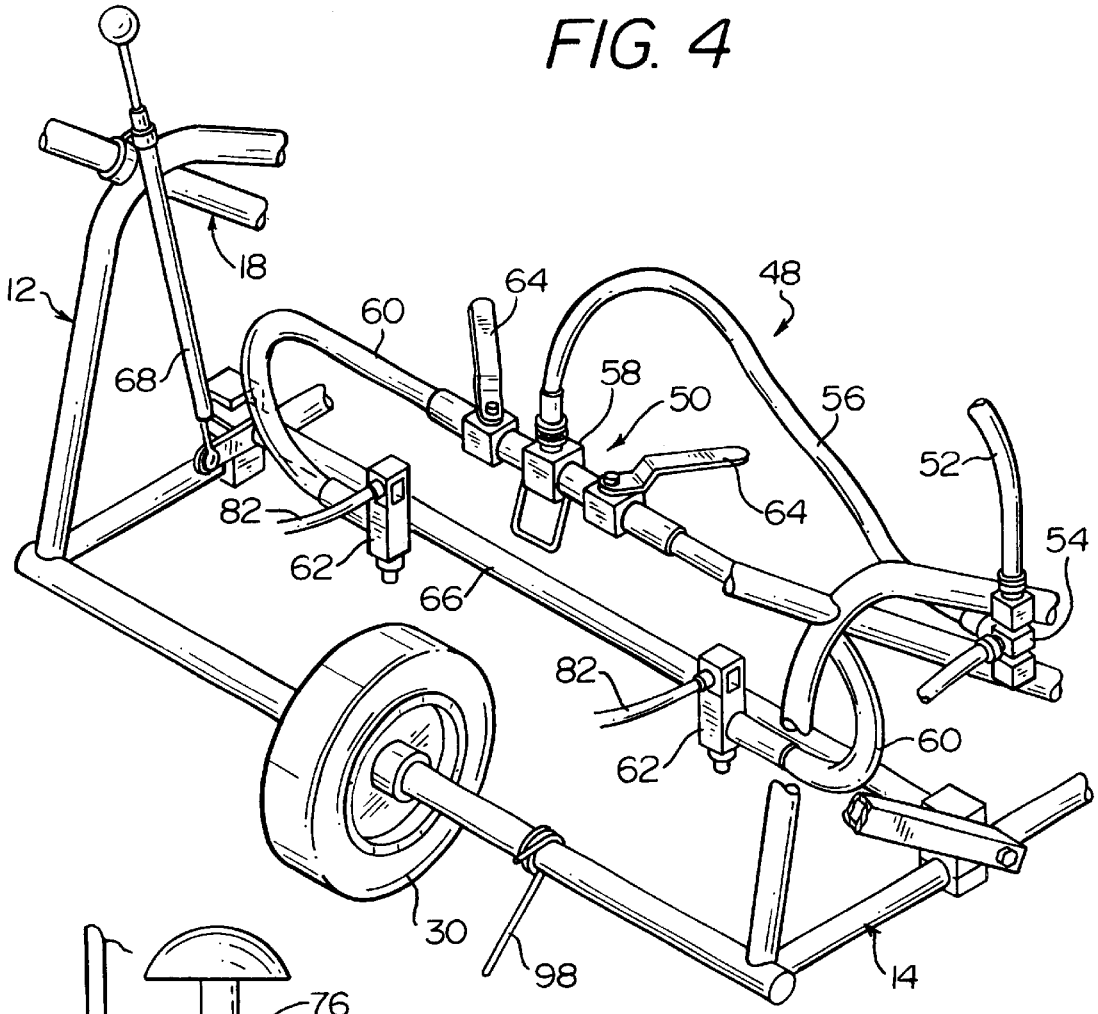
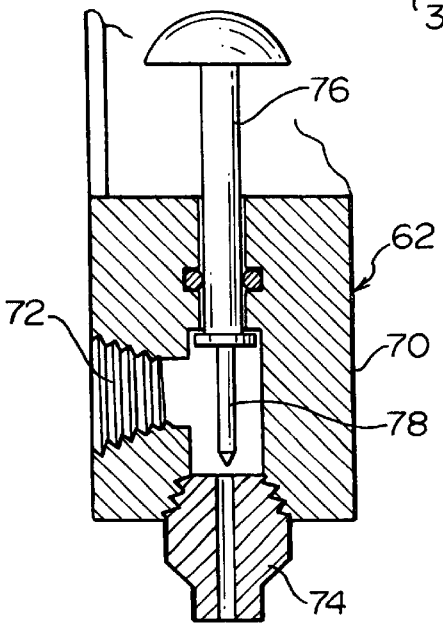
FIG. 5

COLD PROCESS ROOFING FELT APPLICATOR

Application is a Continuation-In-Part (CIP) of application U.S. Ser. No. 09/193,076, filed Nov. 16, 1998 entitled "COLD PROCESS ROOFING FELT APPLICATOR", now abandoned.

FIELD OF THE INVENTION

The present invention relates to cold process roof application, and more particularly to a cold process roofing felt applicator for efficiently creating a multi-ply membrane on a roof.

BACKGROUND OF THE INVENTION

As background, when roofers are typically installing a cold process roof membrane they first attach a base ply (i.e. roofing felt) over the insulation, existing roof membrane or designated substrate. The base applied may be fiberglass, polyester, organic material, modified bitumen or other roofing felt material. The roofers then hand spray adhesive material (e.g. an asphalt cold process material) to the base ply. They then hand lay roofing felt over the adhesive and then hand broom or squeegee another layer of cold process adhesive over that first layer of roofing felt. Over that cold process adhesive they then lay an additional layer of roofing felt. This built up roofing felt/cold process adhesive may comprise several layers and is currently typically done manually.

Others have addressed problems inherent in the hot process application of roofing materials with various dispensing systems. For example U.S. Pat. No. 4,869,044, issued to R. D. Wald discloses a method of applying heated roofing paper. U.S. Pat. No. 4,761,201, issued to S. C. Nichols, Jr., discloses a self-contained apparatus to guide a roll of roofing material, to heat the departing roofing material, and to sealably lay the heated roofing material on a roof surface. U.S. Pat. No. 5,213,278, issued to J. V. Holback et.al., describes an apparatus for applying web shaped material to a substrate.

U.S. Pat. No. 4,725,328, issued to W. Arnold, discloses a single ply roofing applicator with a heater. U.S. Pat. No. 4,460,433, issued to W. K. Boyd, discloses a pressure roller for roofing machines.

OBJECTS AND SUMMARY OF THE INVENTION

It is therefore a principal object of the present invention to automate the cold process roofing felt application process.

It is another object to efficiently relieve stress in the roofing felt prior to its application to the roof.

It is yet another object to provide enhanced urging of the roofing felt against the roof in a manner that compensates for roof surface irregularities.

These and other objects are achieved by the present invention which is a cold process roofing felt applicator. In one broad aspect, the applicator includes a frame assembly, a plurality of wheels attached to this frame assembly, a spindle assembly supported by the frame assembly, and a plurality of stress-relief rollers. The frame assembly includes left and right side support assemblies which include respective left and right side handle assemblies. Elongated support elements secure the left side support assembly to the right side support assembly. The wheels moveably support the frame assembly relative to the roof. The spindle assembly is supported by the left and right side support assemblies. The spindle assembly is capable of holding a spool of roofing felt. The stress-relief rollers extend between the left and right side support assemblies. When an operator desires to apply roofing felt, roofing felt is dispensed from the spool of roofing felt and is directed serially through the plurality of stress-relief rollers so as to relieve stress in the roofing felt prior to its application to the roof.

In a more narrow aspect, the applicator includes an adhesive material dispenser assembly attached to the frame assembly for dispensing adhesive material as the roofing felt is being applied.

In another broad aspect, the applicator includes a frame assembly, a plurality of wheels attached to the frame assembly, a spindle assembly, and a final roller/segmented outfeed roller assembly operably attached to the frame assembly. When an operator desires to apply roofing felt, felt is dispensed from the spool of roofing felt and is directed under a segmented roller of the final roller/segmented outfeed roller assembly for providing enhanced urging of the roofing felt against its substrate in a manner that compensates for roof surface irregularities.

The present invention utilizes pressure supplied adhesive rather than gravity supplied/fed adhesive. This provides uniform adhesive spray coverage.

Other objects, advantages, and novel features will become apparent from the following detailed description of the invention when considered in conjunction with the accompanying drawings.

BRIEF DESCRIPTION OF THE DRAWINGS

FIG. 4 is a rear perspective view of the roofing felt applicator, with major portions not shown to highlight the novel adhesive material dispenser assembly of the present invention.

FIG. 5 is a view, partially in cross-section, of a spray nozzle assembly of the present invention.

The same reference characters designate the same parts or elements throughout the drawings.

DETAILED DESCRIPTION OF THE PREFERRED EMBODIMENTS

Figure 1:
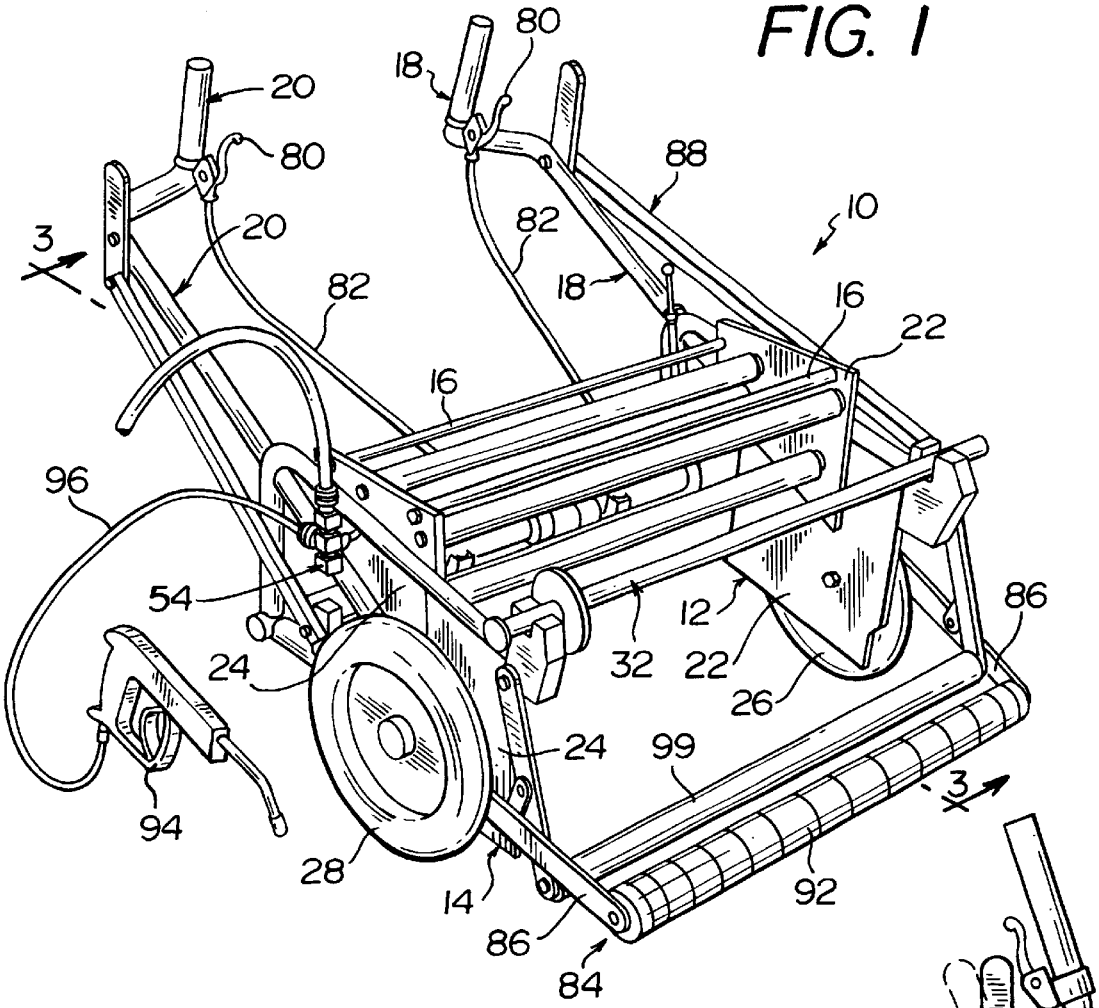
FIG. 1 is a perspective view of the cold process roofing felt applicator of the present invention.
Figure 2:
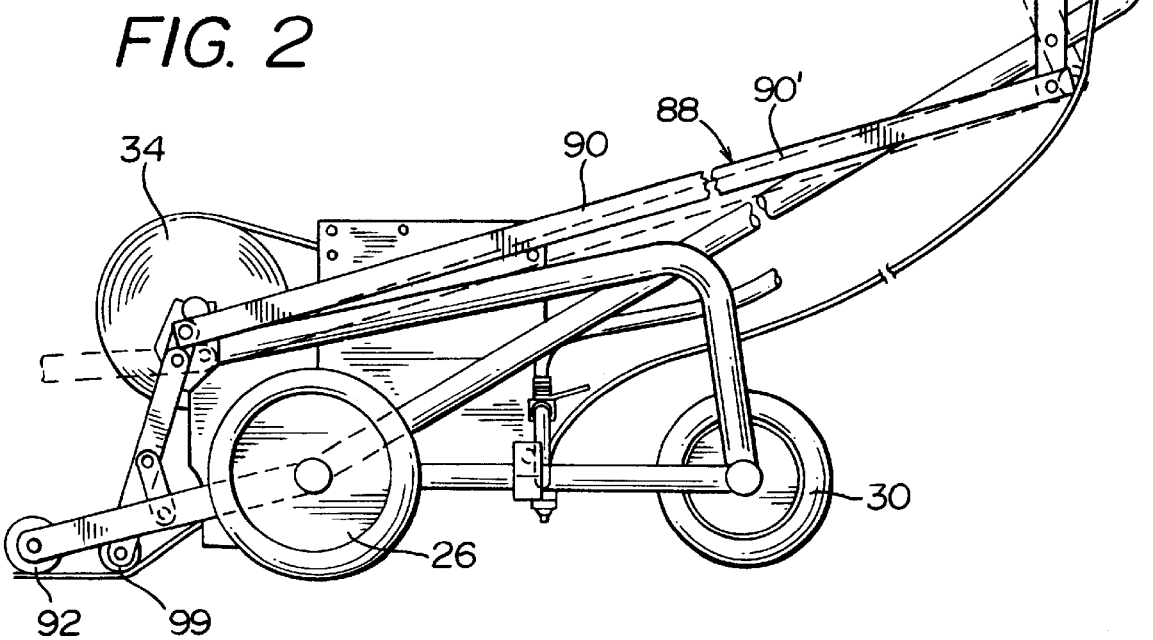
FIG. 2 is a left side view of the cold process roofing felt applicator of FIG. 1.
Figure 3:
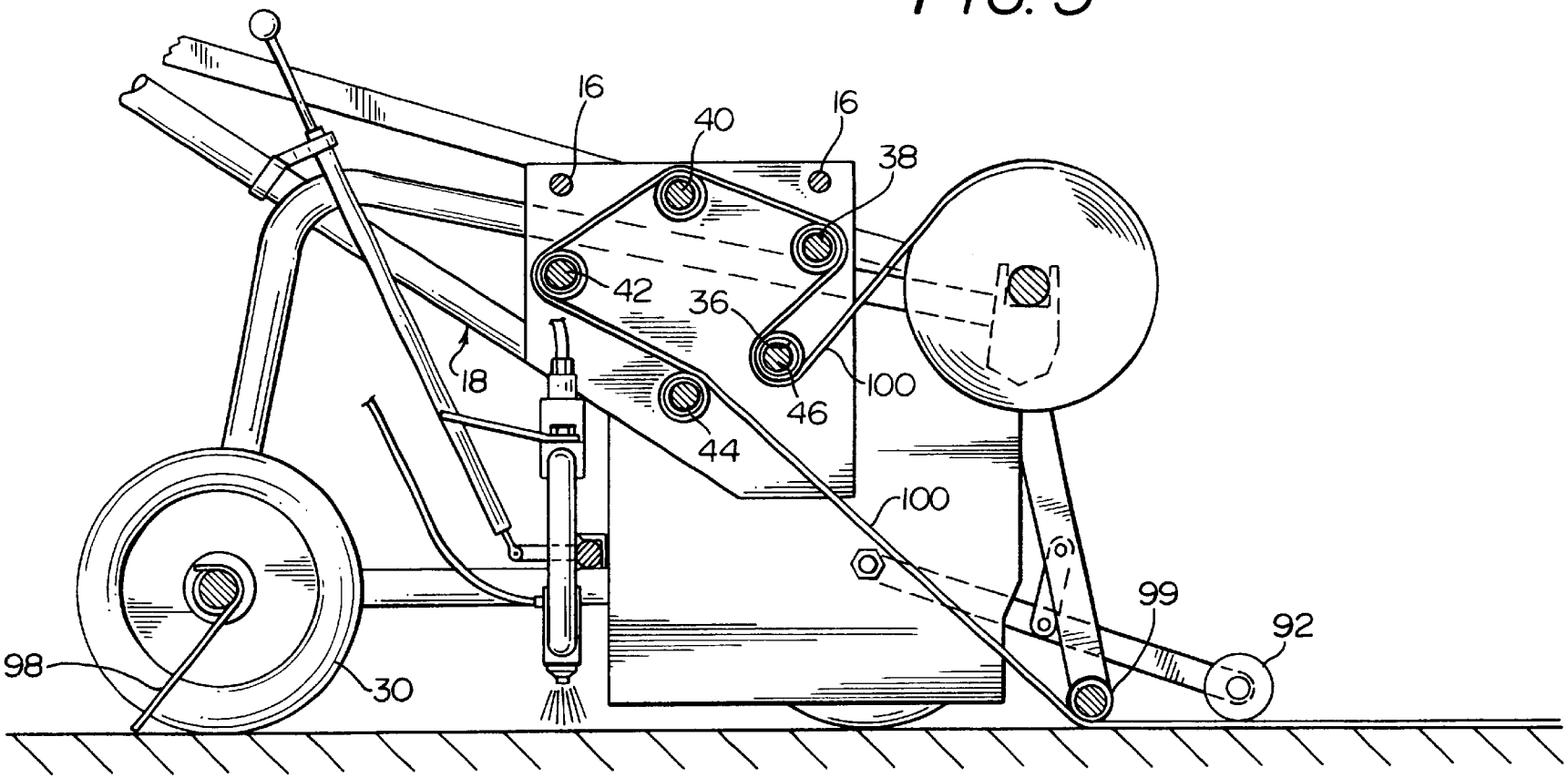
FIG. 3 is a view taken along Line 3—3 of FIG. 1.

Referring now to the drawings and the characters of reference marked thereon, FIGS. 1–3 illustrate a preferred embodiment of the present invention, designated generally as 10. The applicator 10 includes a frame assembly which includes left and right side support assemblies, designated generally as 12, 14, respectively. The frame assembly also includes elongated support means 16 for securing the left side support assembly 12 to the right side support assembly 14. The elongated support means 16 comprise threaded rods for securing the left and right side support assemblies 12, 14. Other suitable support means may alternatively be used, such as tubing or bar stock with snap in grooves for retaining the support assemblies. These have been mentioned by way of illustration and not limitation. Obviously there are many ways in which one could support these support assemblies 12, 14.

Each side support assembly 12, 14 includes a respective handle assembly 18, 20. The handle assemblies 18, 20 support levers, as will be discussed in detail below.

Each side support assembly 12, 14 includes a rigid plate 22, 24 with space openings therethrough which retain respective ends of rollers (as will be discussed below). Each rigid plate 22, 24 is actually formed of two rigid plates which are secured together by fasteners (not shown). The handle assemblies 18, 20 are securely attached to the rigid plates 22, 24 by threaded fasteners (not shown).

Two rear wheels 26, 28 and a front wheel 30 are attached to the frame assembly for moveably supporting the frame assembly relative to the roof.

A spindle assembly 32 is supported by the left and right sides support assembly 12, 14 for holding a spool 34 of roofing felt.

A number of stress-relief rollers 36, 38, 40, 42, 44 extend between the left and right side support assemblies 12, 14. Each stress-relief roller includes a spring-loaded axle 46, which allows easy configuring of the rollers. Obviously, other types of suitable axles may be used such as dowel, rods, etc.

Base sheets of roofing material are manufactured flat; however, for transport they are generally cut into 36-foot lengths and, by force, conformed into rolls. This stress (force) creates a curled condition (memory) in the base sheet that is not amenable to quick and efficient installation on a flat surface. Current procedures used, i.e. solar heat, to relax compressive stresses in the inner surface and tensile stresses in the outer surface of the base sheet, are problematic. Rolling the sheet out on the roof and waiting for the sun or atmosphere to bring it back to its original flat condition is time consuming and ineffective most of the time, not to mention labor intensive. As will be discussed below, the present invention removes factory-induced stress (curl) from the base sheet, thus transforming a curled stressed sheet back into its original flat condition for quick application onto a flat substrate (roof).

Referring to FIG. 4, an adhesive material dispenser assembly, designated generally as 48, is attached to the frame assembly for dispensing adhesive material as the roofing felt is being applied. The adhesive material dispenser assembly 48 includes a manifold assembly 50 for receiving fluid adhesive material from a remote pressure pump (not shown) and distributing the adhesive material. Adhesive material is introduced via inlet hose 52. A distributor valve 54 transfers the adhesive material via hose 56 to a manifold filter 58. The manifold filter 58 filters out large particles in the adhesive to help prevent the nozzle from being clogged. Flex hoses 60 distribute the adhesive material to spray nozzle assemblies 62. Shut off valves 64 control adhesive material to their associated spray nozzle assemblies 62.

Each spray nozzle assembly 62 is attached to and supported by a manifold bar 66. The nozzle assemblies 62 are positionable as desired along the manifold bar 66 via lock pin locators (not shown).

The manifold bar 66 can be tilted/adjusted by a manifold adjustment rod 68 attached to the left side support assembly 12. The inclination adjustment controls the adhesive spray pattern.

Referring now to FIG. 5, it can be seen that each spray nozzle assembly 62 includes a body 70 having a fluid inlet 72 and a spray tip retaining outlet 74. A spring return plunger assembly 76 has a tip 78 which is extendable through the spray tip retaining outlet 74 to clean a clogged spray tip in the retaining outlet 74.

Referring again to FIG. 1, a nozzle plunger control lever 80 and control cable 82 control the actuation of the plunger assembly 76 (not shown in FIG. 1).

A final roller/segmented outfeed roller assembly, designated generally as 84 is operatively attached to the frame assembly. The final roller/segmented outfeed roller assembly 84 includes side bars 86 which are operated through a hand lever assembly, designated generally as 88. The hand lever assembly 88 is attached to the frame assembly so as to provide two positions. The hand lever assembly 88 includes a brake arm portion 90 for restricting movement of wheel 26 while in an upper, retracted position, shown in phantom lines 90'. In a lower dispensing position the brake arm portion 90 pivots away from the wheel 26 to release the brake. In this lower position a segmented outfeed roller 92 of the final roller/segmented outfeed roller assembly 84 urges the roofing felt against the roof or its substrate, providing enhanced urging of the roofing felt against the roof in a manner that compensates for roof surface irregularities. The segmented outfeed roller 92 includes pieces of steel bar, with a relatively large hole formed within each piece. A small rod passes through each segmented piece and is attached to side bars 86. Thus, each individual piece is free to float in accordance with the roof's irregular surface.

An auxiliary manual control wand 94 is attached to the adhesive material dispenser assembly for applying detailed touch-up work, as shown in FIG. 1. The control wand 94 is attached to the distributor valve 54 by a flex hose 96.

A spring adjustable pointer 98 is positionable as desired along a wheel axle of wheel 30 so as to guide the frame assembly along a marked line on the roofing felt.

In operation, when an operator desires to apply roofing felt 100, roofing felt 100 is dispensed from the spool 32 and is directed serially through the stress-relief rollers 36, 38, 40, 42 and 44, so as to relieve stress in the roofing felt prior to its application to the roof. The roller 36 provides the majority of the stress relief for reversing the rolled curl (memory). The other rollers flex the roofing felt 100 to further relieve stress and to properly position the roofing felt for disposition on the roof. The felt 100 is then directed under the final roller 99 and segmented rollers 92 of the final roller/segmented outfeed roller assembly 84. Assembly 84 provides enhanced urging of the roofing felt against the roof in a manner that compensates for roof surface irregularities.

Obviously, many modifications and variations of the present invention are possible in light of the above teachings. For example, although the stress-relief rollers are shown in a specific pattern in FIG. 3, this pattern is shown for the purposes of illustration and not limitation. Any suitable pattern of rollers can be used which provided the function of stress relief, as discussed above. It is, therefore, to be understood that within the scope of the appended claims, the invention may be practiced otherwise than as specifically described.

What is claimed and desired to be secured by Letters Patent of the United States is:

What is claimed is:

1. A cold process roofing felt applicator, comprising:

a) a frame assembly, including i) left and right side support assemblies, including respective left and right side handle assemblies; and ii) elongated support means for securing said left side support assembly to said right side support assembly;

b) a plurality of wheels attached to said frame assembly for movably supporting said frame assembly relative to the roof;

c) a spindle assembly supported by said left and right side support assemblies capable of holding a spool of roofing felt; and d) a plurality of stress-relief rollers extending between said left and right side support assemblies, wherein when an operator desires to apply roofing felt, roofing felt is dispensed from the spool of roofing felt and is directed serially through said plurality of stress-relief rollers so as to relieve stress in the roofing felt prior to its application to the roof.

2. The cold process roofing felt applicator of claim 1, further including an adhesive material dispenser assembly attached to said frame assembly for dispensing adhesive material as the roofing felt is being applied.

3. The cold process roofing felt applicator of claim 2, wherein said adhesive material dispenser assembly, comprises:

a) a manifold assembly for receiving fluid adhesive material from a remote pressure pump and distributing said adhesive material; and b) a plurality of spray nozzle assemblies attached to said manifold assembly for directing fluid adhesive material toward said felt.

4. The cold process roofing felt applicator of claim 3, wherein said adhesive material dispenser assembly, further comprises:

at least one control valve assembly associated with a respective one of said handle assemblies, and connected to said manifold assembly, for controlling the dispensing of the adhesive material.

5. The cold process roofing felt applicator of claim 3, wherein each of said plurality of spray nozzle assemblies, comprises:

a) a body including a fluid inlet and a spray tip retaining outlet; and b) a spring return plunger assembly having a tip which is extendable through said spray tip retaining outlet to clean a clogged spray tip in said retaining outlet.

6. The cold process roofing felt applicator of claim 3, wherein said manifold assembly comprises a manifold bar which extends between said left and right side support assemblies, said manifold bar for supporting said plurality of spray nozzle assemblies, wherein said spray nozzle assemblies are positionable along desired locations on said manifold bar to provide the desired dispensing overlap of adhesive material.

7. The cold process roofing felt applicator of claim 6, further including a manifold adjustment rod attached to said manifold bar for adjusting the inclination of said spray nozzle assemblies.

8. The cold process roofing felt applicator of claim 3, further including an auxiliary manual control wand attached to said adhesive material dispenser assembly for applying detailed touch-up work.

9. The cold process roofing felt applicator of claim 1, wherein each said side support assembly, comprises:

a rigid plate having a plurality of spaced openings therethrough for retaining a respective end of a respective roller.

10. The cold process roofing felt applicator of claim 9, wherein each stress-relief roller includes a spring loaded axle which allows easy configuring of stress-relief rollers.

11. The cold process roofing felt applicator of claim 1, further including a final roller/segmented outfeed roller assembly operably attached to said frame assembly to operate in at least two positions, an upper, retracted position, and a lower dispensing position, said lower position for urging the roofing felt against the roof, a segmented outfeed roller of said final roller/segmented outfeed roller assembly for providing enhanced urging of the roofing felt against the roof in a manner that compensates for roof surface irregularities.

12. The cold process roofing felt applicator of claim 11, wherein said final roller/segmented outfeed roller assembly further includes a hand lever assembly attached to said frame assembly so as to provide said two positions.

13. The cold process roofing felt applicator of claim 12, wherein said hand lever assembly comprises a brake arm portion for restricting movement of one of said wheels while in said upper position.

14. The cold process roofing felt applicator of claim 1, further including a spring adjustable pointer positionable as desired along a wheel axle of one of said plurality of wheels so as to guide said frame assembly along a marked line on said roofing felt.

15. A cold process roofing felt applicator, comprising:

a) a frame assembly, including i) left and right side support assemblies, including respective left and right side handle assemblies; and ii) elongated support means for securing said left side support assembly to said right side support assembly;

b) a plurality of wheels attached to said frame assembly for movably supporting said frame assembly relative to the roof;

c) a spindle assembly supported by said left and right side support assemblies capable of holding a spool of roofing felt;

d) a plurality of stress-relief rollers extending between said left and right side support assemblies; and, e) a final roller/segmented outfeed roller assembly operably attached to said frame assembly, comprising a segmented outfeed roller;

wherein when an operator desires to apply roofing felt, roofing felt is dispensed from the spool of roofing felt and is directed serially through said plurality of stress-relief rollers so as to relieve stress in the roofing felt prior to its application to the roof and the roofing felt is directed under said segmented outfeed roller for providing enhanced urging of the roofing felt against the roof in a manner that compensates for roof surface irregularities.

16. The cold process roofing felt applicator of claim 15, further including an adhesive material dispenser assembly attached to said frame assembly for dispensing adhesive material as the roofing felt is being applied.

17. The cold process roofing felt applicator of claim 16, wherein said adhesive material dispenser assembly, comprises:

a) a manifold assembly for receiving fluid adhesive material from a remote pressure pump and distributing said adhesive material; and b) a plurality of spray nozzle assemblies attached to said manifold assembly for directing fluid adhesive material toward said felt.

18. The cold process roofing felt applicator of claim 17, wherein said adhesive material dispenser assembly, further comprises:

at least one control valve assembly associated with a respective one of said handle assemblies, and connected to said manifold assembly, for controlling the dispensing of the adhesive material.

19. The cold process roofing felt applicator of claim 17, wherein each of said plurality of spray nozzle assemblies, comprises:

a) a body including a fluid inlet and a spray tip retaining outlet; and b) a spring return plunger assembly having a tip which is extendable through said spray tip retaining outlet to clean a clogged spray tip in said retaining outlet.

20. The cold process roofing felt applicator of claim 15, wherein each said side support assembly, comprises:

a rigid plate having a plurality of spaced openings therethrough for retaining a respective end of a respective roller.

* * * * *